US005366560A

United States Patent [19]

Rubey, III et al.

[11] Patent Number: 5,366,560

[45] Date of Patent: Nov. 22, 1994

[54] CLEANING METHOD UTILIZING SODIUM BICARBONATE PARTICLES

[75] Inventors: Arthur C. Rubey, III; Andrew M. Taylor, both of San Antonio, Tex.

[73] Assignee: Yelapa Enterprises, Inc., San Antonio, Tex.

[21] Appl. No.: 116,405

[22] Filed: Sep. 3, 1993

[51] Int. Cl.[5] ..... B08B 7/00; B24B 1/00

[52] U.S. Cl. ..... 134/7; 134/42

[58] Field of Search ..... 134/7, 25.1, 42; 51/320, 321, 436, 439, 427

[56] References Cited

U.S. PATENT DOCUMENTS

| | | | |
|---|---|---|---|
| 2,570,004 | 10/1951 | Penney | 91/44 |
| 3,795,348 | 3/1974 | Vertue | 222/193 |
| 3,994,097 | 11/1976 | Lamb | 51/11 |
| 4,002,372 | 1/1977 | Edwards et al. | 302/25 |
| 5,037,247 | 8/1991 | Kaiser et al. | 406/153 |
| 5,054,249 | 10/1991 | Rankin | 51/436 |
| 5,083,710 | 1/1992 | Mcloughlin et al. | 239/690 |
| 5,099,619 | 3/1992 | Rose | 51/436 |
| 5,160,547 | 11/1992 | Kirschner et al. | 134/7 |

FOREIGN PATENT DOCUMENTS

| | | |
|---|---|---|
| 736207 | 9/1955 | United Kingdom . |
| WO9109800 | 7/1991 | WIPO . |

*Primary Examiner*—Paul Lieberman
*Assistant Examiner*—Lorna M. Douyon

[57] ABSTRACT

A method for effecting the continuous reliable supply of sodium bicarbonate particles to a blasting nozzle employing pressured air or water as the means for conveying such particles into impact engagement with a surface to be cleaned.

4 Claims, 3 Drawing Sheets

CLEANING METHOD UTILIZING SODIUM BICARBONATE PARTICLES

BACKGROUND OF THE INVENTION

1. FIELD OF THE INVENTION

This invention relates to the art of cleaning contamination from surfaces such as old paint, grease or rust, through the use of a blast of sodium bicarbonate particles transported into impact engagement with the surface by a stream of pressurized air or water.

2. SUMMARY OF PRIOR ART

In recent years, there has been an increase in use of cleaning systems utilizing a blast of sodium bicarbonate particles suspended in a stream of pressured air or water. Sodium bicarbonate has distinct advantages over sand particles used for many years for similar purposes. Because of the toxic nature of sand particles when inhaled, government regulations require the use of sophisticated fresh air breathing masks to insure that the operator will not be filling his lung with silica products. For the same reason, sand blasting cannot be economically utilized to clean machines in food processing plants because of the difficulty of removing the silica particles from wherever they fall, and particularly from bearings.

In contrast, sodium bicarbonate particles are reasonably soluble in water and can be readily removed by hosing down the machine after the blast cleaning. Sodium bicarbonate is not toxic and does not require elaborate fresh air breathing masks for the operator. Only standard protective clothing and ear and eye protection may be utilized but this is not necessarily a requirement but depends primarily on the substrate and the coating being removed. Sodium bicarbonate can be utilized to remove surface corrosion, lime, scale, paint, grease and machine oil from any surface, without damaging the surface.

The employment of sodium bicarbonate as a blast type cleaning medium does encounter problems in effecting the transfer of sodium bicarbonate particles from a supply hopper to the nozzle from which the pressured water or air is issued and where the sodium bicarbonate is mixed into the pressured fluid. The method and apparatus heretofore employed followed the pattern of apparatus utilized for sand blasting in that a high air pressure was maintained on the top of the mass of sodium bicarbonate particles disposed in the supply hopper. The reason for the high pressure was that the particles normally had to be introduced into the high pressure air or water blasting stream, thus requiring that a higher pressure be maintained above the mass of sodium bicarbonate particles to effect the feeding of a desired quantity per unit of time to the nozzle. Under these conditions, the sodium bicarbonate particles have been found to not feed uniformly and consistently into the stream of pressured air or water. Moreover, the performance of such prior art apparatus was highly dependent on the particular size of sodium bicarbonate particles being utilized as a blasting medium.

In an attempt to overcome these particle delivery problems, a sodium bicarbonate crystal has been developed and marketed under the trademark "ARMEX" by the Church & Dwight Co., Inc., of Princeton, N.J. A flow additive is applied to the sodium bicarbonate particles to promote the flow of the resulting crystals from the hopper and into the pressured stream of air or water passing through the discharge nozzle.

Even this improved particle form of sodium bicarbonate which, of course, is more expensive than untreated sodium bicarbonate particles, still suffered from clogging and/or inconsistent rates of delivery of the sodium bicarbonate particles to the pressurized fluid stream.

There is a need, therefore, for an improved method and apparatus for effecting blast cleaning through the utilization of sodium bicarbonate particles, whether treated with a flow promotion agent or not, which will effect a more reliable and consistent delivery of such particles to the blast nozzle and which can be conveniently adjusted to accommodate a substantial range of particle sizes of sodium bicarbonate.

SUMMARY OF THE INVENTION

A sodium bicarbonate particles blasting system embodying the method and apparatus of this invention comprises a hopper for containing a supply of sodium bicarbonate particles. The hopper has a conical bottom surface terminating in a vertical flow passage. An orifice ring is removably mounted in the flow passage and a plurality of such rings, having different orifice sizes, are provided to insure the optimum performance of the delivery system for different sizes of sodium bicarbonate particles placed in the hopper. The top of the hopper is exposed to atmospheric pressure.

A pair of pipes are sealingly secured in transverse relationship to the bottom end of the vertical flow passage by a T-fitting which provides communication with such passage. Thus particles may flow by gravity into the pipes but such flow will be limited to a pile of particles filling the portion of the bores of the pipes immediately beneath the discharge passage.

The blast nozzle is connected to the end of a first hose. Water or air under moderate pressure, say 750 to 5,000 pounds per square inch, is supplied through such hose. A Venturi passage is disposed between the end of the hose and the discharge end of the blast nozzle. A transverse flow passage is provided in the Venturi element adjacent to its minimum diameter portion, which communicates through a second hose with the end of one of the transverse pipes mounted on the bottom of the hopper. A suction force is thus generated in the two pipes and the vertical particle passage.

The end of the second transverse pipe has an air flow regulating valve connected to it to permit reduction of the flow of atmospheric air through the pipe, due to the modest suction force on the order of 1 to 10 pounds per square inch produced by the second hose connection to the Venturi passage. By proper selection of the diameter of the bore of the orifice ring and the amount of restriction of air flow into the other end of the pipe, a stream of particles will be transported to the blast nozzle which preferably occupies not more than 25 percent of the cross-sectional area of the pipe. In effect, the moving particles constitute a fluidized bed of such particles, within the second hose hence there is no tendency for the particles to clog or to significantly vary the volume of particles per unit of time delivered to the discharge nozzle.

While the method and apparatus of this invention functions well with the aforesaid "ARMEX"' blast media, good results are also obtained with the utilization of untreated sodium bicarbonate particles so long as the particles are of the same general size.

The size of the particles determines the size of the bore of the orifice ring. Larger particles require a larger bore diameter than do smaller particles.

Further advantages of this invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
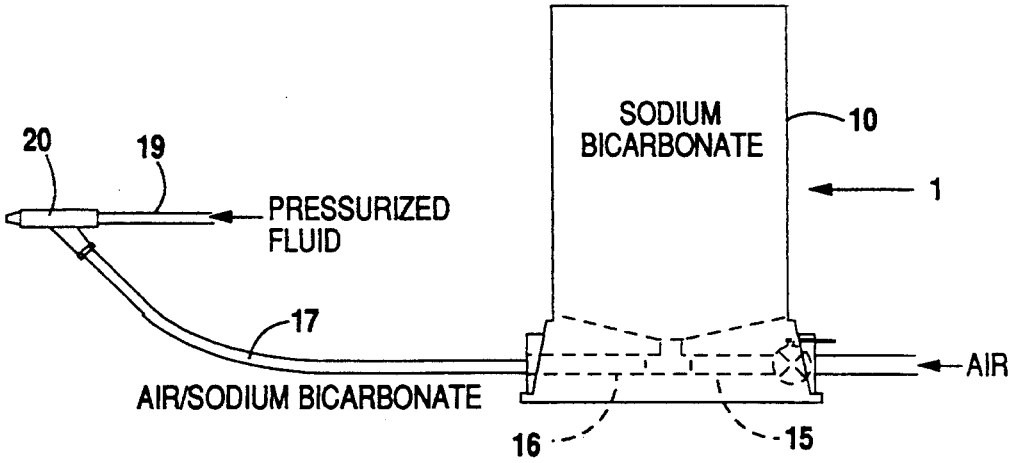
FIG. 1 is a schematic view of the apparatus embodying this invention.
Figure 3:
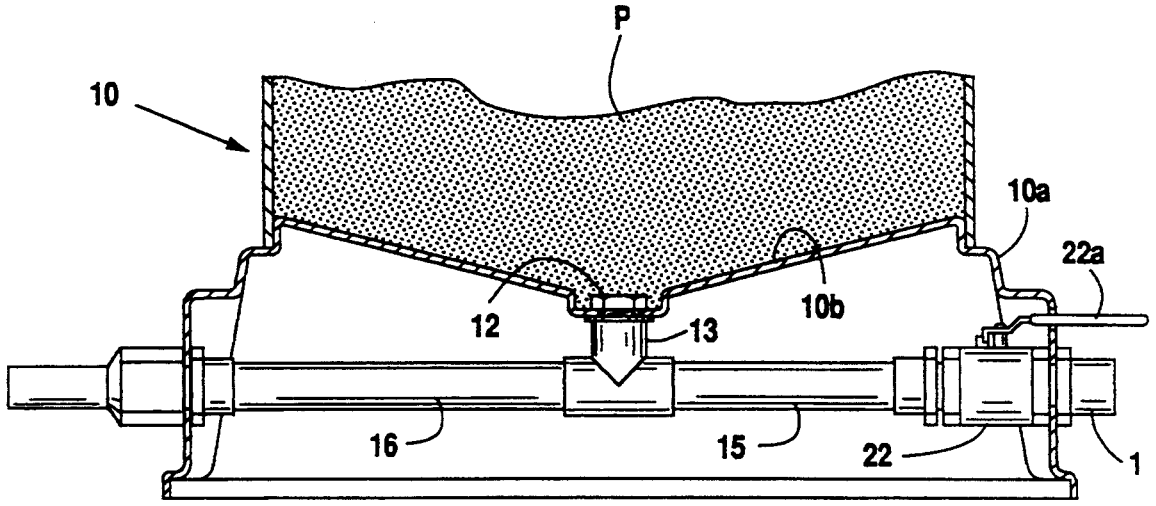
FIG. 3 is a partial sectional view taken on the Plane 3—3 of FIG. 2.
Figure 2:
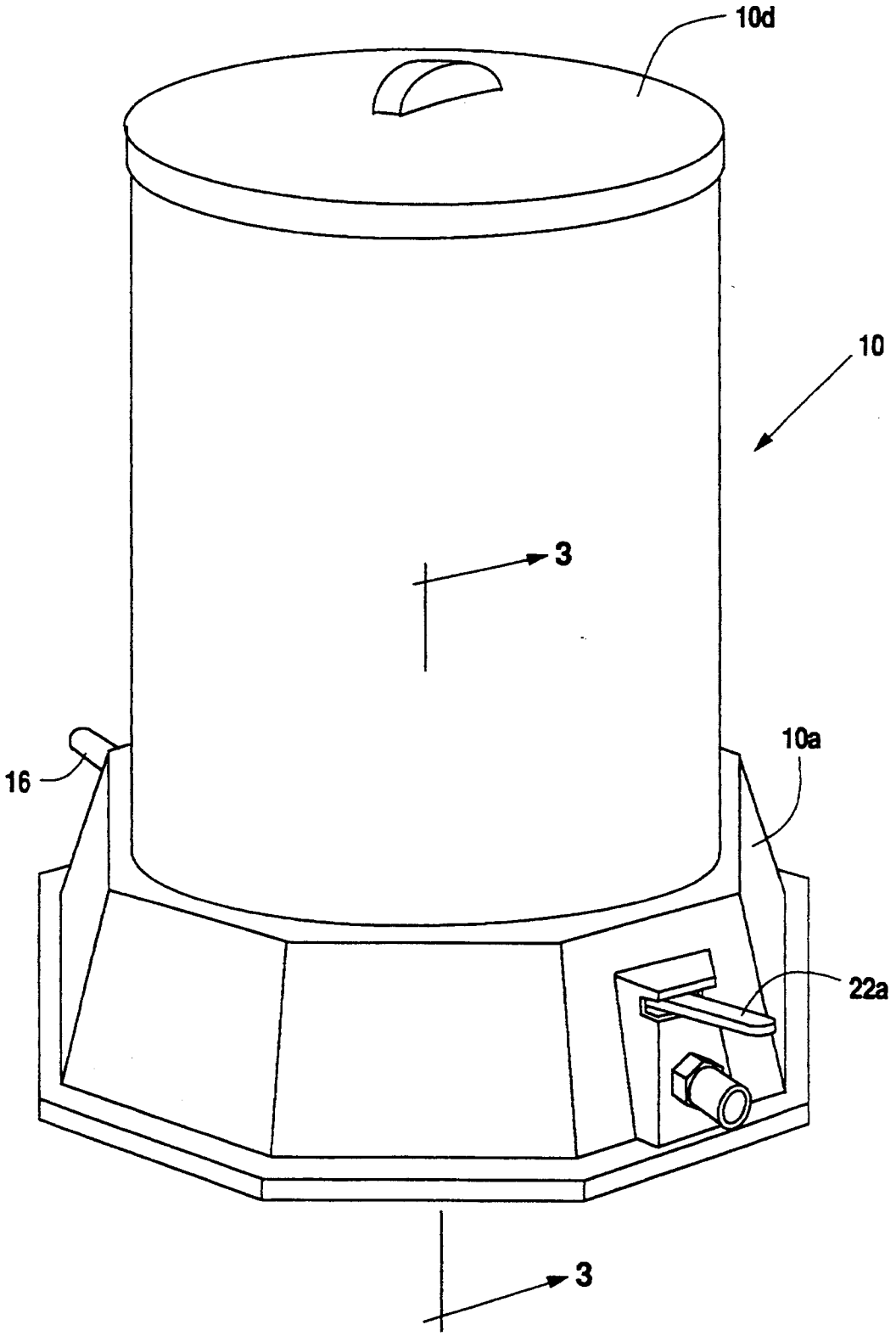
FIG. 2 is a perspective view of a hopper for containing sodium bicarbonate and the mechanism for metering the rate of flow of the sodium bicarbonate particles out of the hopper.

The apparatus 1 embodying this invention comprises a container 10 for sodium bicarbonate particles P. Container 10 is mounted on an annular base portion 10*a*, and has a conically shaped, inwardly sloping bottom wall, 10*b*, terminating in a central aperture 10*c*.

A hollow bolt 12 having a shank portion 12*a*, projects through the aperture 10*c* and threadably engages the shank portion 13*a* of an ordinary T-shaped pipe fitting 13. The size of the vertical discharge passage for the particles P is determined by a selected one of a plurality of tubular orifices 11, which are threadably secured to internal threads 12*c*, provided in the bolt 12. A sealing washer 14 is provided between the bottom wall 10*b* of the hopper and the end of the shank portion 13*a* of the pipe fitting 13. Each tubular orifice element 11 has a different size discharge passage 11*a* formed therein, thus regulating the flow rate of the particles of sodium bicarbonate into the T-shaped pipe fitting 13.

For larger particles, the selected orifice 11 would have a larger passage 11*a* than for smaller particles of sodium bicarbonate. A cover 10*d* is provided for the top of the hopper 10, but this cover is merely for the purpose of preventing dirt from falling into the supply of sodium bicarbonate particles and is not airtight, thus exposing the particles within the hopper 10 to atmospheric pressure.

The other ends of the T-shaped pipe coupling 13 are respectively threadably connected to an air inlet pipe 15 and a suction pipe 16, both of which are disposed within the hollow interior of the base 10*a*. In effect, the head portion 13*b* of the T-shaped coupling 12 and the pipes 15 and 16 may be considered to be a continuous pipe which is transversely connected to the orifice 11*a*, through which particles P may flow into the continuous pipe.

Figure 4:
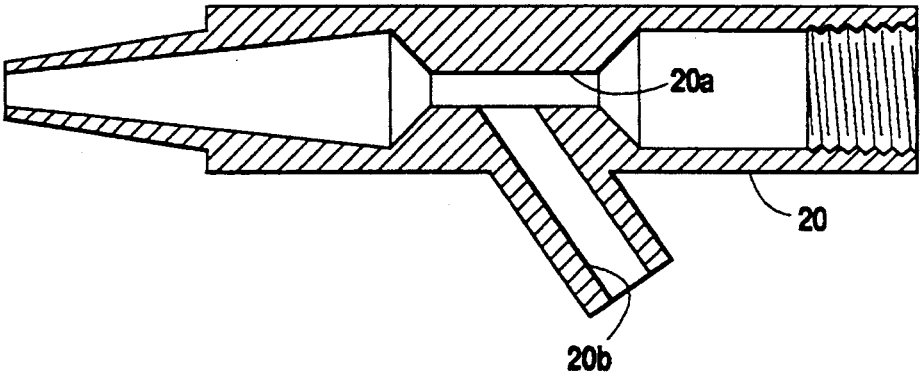
FIG. 4 is a sectional view of a conventional Venturi utilized in the blasting nozzle.
Figure 5:
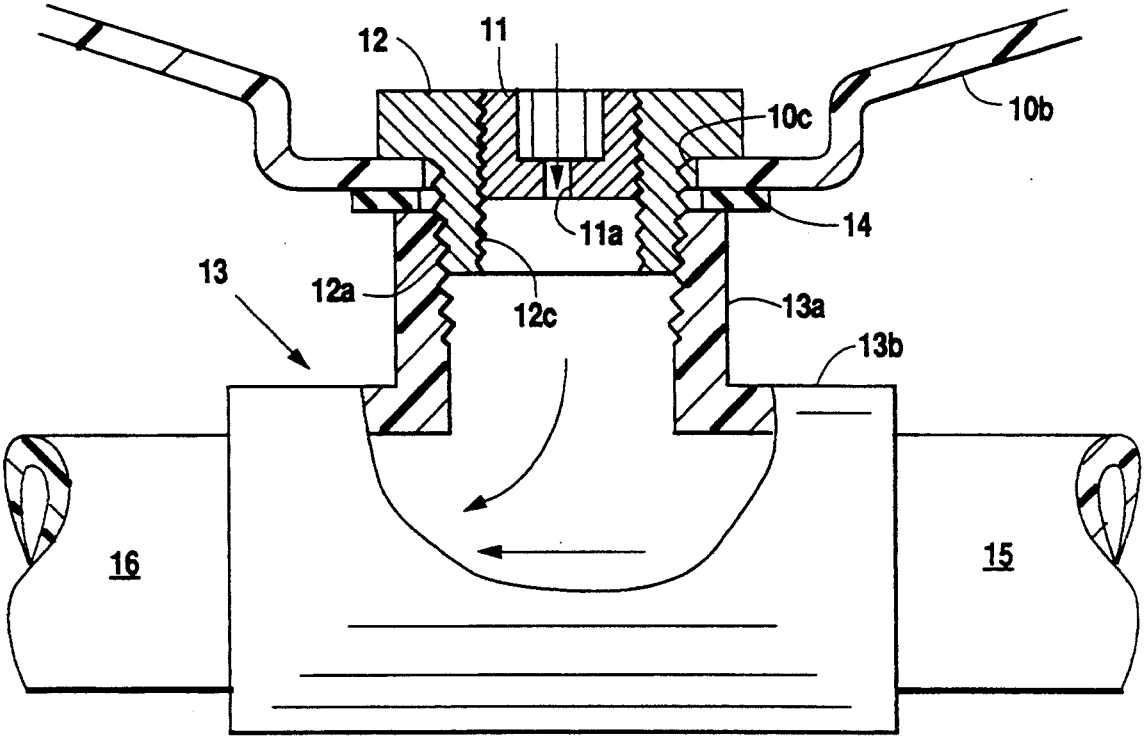
FIG. 5 is an enlarged scale vertical sectional view of the vertical discharge portion of the hopper containing the sodium bicarbonate particles.

As best shown in FIG. 1, the air suction pipe 16 is connected by a hose 17 to a discharge nozzle element 20 connected to the end of a supply pipe 13 for supplying pressured air or water to the nozzle 20. As best shown in FIG. 4, the suction pipe 16 communicates with a transverse fluid passage 20*b* in the nozzle 20 which connects with the minimum diameter portion of a Venturi passage 20*a*, defined within nozzle 20. The suction pipe 16 is then subjected to a suction pressure produced through the discharge of pressured fluid supplied by hose 19 through the constricted portion of the Venturi 20*a*.

The air inlet pipe 15 is provided with a conventional adjustable flow valve 22, by which the amount of air sucked into the pipe 15 by the suction produced by the Venturi nozzle 20*a* may be adjusted. One feature of the apparatus embodying this invention is the fact that if the valve 22 is shifted by its operating handle 22*a* to a fully closed position, the entire suction pressure generated by the Venturi passage 20*a* is applied to the bottom of the hopper full of particles P. Under this condition, the particles P will not flow continuously through the selected aperture 11*a* of the orifice 11, but will tend to move in clumps, which often effect the plugging of the air suction pipe 16 and/or hose 17.

For the successful operation of the apparatus, the amount of inlet air permitted by the valve 22 is correlated with the size of the inlet of the hopper discharge orifice 11*a*, so as to produce a volume flow of particles P which at all times occupies less than 25 per cent of the cross-sectional area of the pipe 16 and the hose 17. When the hose 17 is fabricated from a transparent plastic material, the particles P can be observed as a distinct stream, similar to a fluidized bed, generally moving along the bottom surface of the hose 16 and, as stated above, occupying a minor portion of the cross-sectional area of such hose. Under these conditions, no clogging of the sodium carbonate particles occurs.

The suction pressure applied to the sodium bicarbonate particles P varies, of course, with the pressure of the air or water supplied to the nozzle 20. For most applications, a suction pressure on the order of 1 to 10 pounds per square inch will produce a satisfactory feeding of the sodium bicarbonate particles P from the hopper 10 into the pipe 16. This amount of suction pressure is readily obtained when the pressured fluid applied to the nozzle 20 by hose 19 is maintained at the conventional level of 750 to 5,000 pounds per square inch. Obviously, larger particles of sodium carbonate will require larger suction pressures, but in no case, will sufficient suction pressure be applied to the sodium carbonate particles P to produce a filling of the cross-sectional area of the pipe 16 and/or the hose 17.

The aforedescribed method and apparatus can be utilized with treated sodium bicarbonate particles, such as those sold under the trademark "ARMEX", but provides equally satisfactory results when utilized with untreated particles of sodium bicarbonate, so long as the particles are of substantially uniform size. Thus, the method and apparatus of the present invention has effected a solution to a long existing problem in the art of utilizing sodium bicarbonate particles for surface cleaning purposes.

What is claimed and desired to be secured by Letters Patent is:

1. The method of blasting a contaminated surface by baking soda particles comprising the steps of:

depositing a mass of sodium bicarbonate particles having substantially uniform particle size in a hopper having an inwardly tapering conical bottom surface defining a discharge passage;

exposing the top of said mass to atmospheric pressure;

inserting an orifice ring in said discharge passage having a bore diameter selected for the particle size of the sodium bicarbonate;

disposing a horizontal pipe beneath said orifice ring and sealingly connecting said discharge passage with the bore of said pipe, thereby limiting the gravity flow of said particles from said hopper;

providing a blasting nozzle having a Venturi configuration bore;

supplying pressured fluid to said nozzle to flow through said Venturi configuration bore;

connecting one end of a hose transversely with the minimum diameter portion of said Venturi configuration bore;

connecting the other end of said hose to one end of said pipe, thereby applying a suction force to the bore of said pipe to move said sodium bicarbonate particles in said pipe in a continuous flow stream through said hose and into the pressured water stream issuing from said nozzle; and adjusting atmospheric air flow into the other end of said pipe to limit the volume of particles flowing through said hose to less than 25 per cent of the flow area of said hose.

2. The method of claim 1 wherein said pressured fluid comprises water at a pressure in the range of 750 to 5,000 pounds per square inch.

3. The method of claim 1 wherein the hose is of transparent plastic material.

4. The method of claim 1 wherein the suction force is in the order of 1 to 10 pounds per square inch.

* * * * *